US009068397B2

(12) United States Patent
Danko

(10) Patent No.: US 9,068,397 B2
(45) Date of Patent: Jun. 30, 2015

(54) DRILLING APPARATUS AND METHOD

(75) Inventor: George L. Danko, Reno, NV (US)

(73) Assignee: Board of Regents of the Nevada System of Higher Education, on behalf of the University of Nevada, Reno, Washington, DC (US)

( * ) Notice: Subject to any disclaimer, the term of this patent is extended or adjusted under 35 U.S.C. 154(b) by 4 days.

(21) Appl. No.: 13/553,668

(22) Filed: Jul. 19, 2012

(65) Prior Publication Data

US 2013/0043075 A1 Feb. 21, 2013

Related U.S. Application Data

(60) Provisional application No. 61/509,389, filed on Jul. 19, 2011, provisional application No. 61/673,386, filed on Jul. 19, 2012.

(51) Int. Cl.

| | |
|---|---|
| ***E21B 10/36*** | (2006.01) |
| ***E21B 4/06*** | (2006.01) |
| ***E21B 10/62*** | (2006.01) |
| ***E21B 7/06*** | (2006.01) |
| ***E21B 21/08*** | (2006.01) |

(52) U.S. Cl.
CPC . *E21B 4/06* (2013.01); *E21B 10/62* (2013.01); *E21B 7/06* (2013.01); *E21B 21/08* (2013.01)

(58) Field of Classification Search
CPC ..... E21B 4/06; E21B 21/08; E21B 10/62; E21B 7/06; E21B 7/00
USPC ..... 175/414, 405.1, 405, 293, 57
See application file for complete search history.

(56) References Cited

U.S. PATENT DOCUMENTS 2,168,806 A * 8/1939 Reilly ..... 60/544
5,735,358 A * 4/1998 Lyon ..... 175/96

OTHER PUBLICATIONS

Bruno, M., et al., Advanced Simulation Technology for Combined Percussion and Rotary Drilling and Cuttings Transport, Gas TIPS, Winter 2005, 5-8.
Fernandez, J., et al., Integrated Drilling System Using Mud Actuated Down Hole Hammer as Primary Engine, Final Technical Report, Report # 34365R05, 2005, 1-35.
Green, S., et al., Single Cutter Impact Tests Investigate Depp-Well Hammer-Drilling Performance, Paper SPE 97173, *2005 SPE Annual Technical Conference and Exhibition*, Dallas, TX, Oct. 9-12, 2005, 1-11.

(Continued)

*Primary Examiner* — Yong-Suk (Philip) Ro
(74) *Attorney, Agent, or Firm* — Ryan A. Heck; UNR-DRI Technology Transfer Office

(57) ABSTRACT

The present disclosure provides a drilling method and drill. According to a disclosed method, multiple reciprocating rock-breaking elements, including a hammer drill bit, are used. The elements are moved in alternation to each other such that the net volume displacement by the moving parts is reduced for reducing compression work and thus for losing useful energy from the available amount from the drill bit engine for rock breaking. If desired, a small component of the net volume displacement is kept for enhancing PVW for enhancing rock chipping by tensile strength. The method also includes synchronizing the peak of the pressure depression wave with that of the impact moment of the drill bit's reciprocating motion to enhance, rather than hamper, rock breaking by the creation of PVW.

2 Claims, 4 Drawing Sheets

(56) References Cited

OTHER PUBLICATIONS

Han, G., et al., Percussion Drilling in Oil Industry: Review and Rock Failure Modelling, AADE-05-NTCE-59, *the AADE National Technical Conference and Exhibition*, Houston, TX, Apr. 5-7, 2005, 1-10.
Han, G., et al., Technology Assessment for Fundamental Research on Percussion Drilling: Improved Rock Mechanics Analysis, Advanced Simulation Technology, and Full-Scale Laboratory Investigations, U.S. Department of Energy Contract No. DE-FC26-03NT41999, Terralog Technologies USA, Inc., 2005, 1-7.
Han, G., et al., Lab Investigations of Percussion Drilling: From Single Impact to Full Scale Fluid Hammer, ARMA/USRMS 06-962, *the 41st U.S. symposium on Rock Mechanics* (*USRMS*): "*50 years of Rock Mechanics—Landmarks and Future Challenges*," Golden, CO, Jun. 17-21, 2006, 1-8.
Hance, C.N., Factors Affecting Costs of Geothermal Power Development, A Publication by the Geothermal Energy Association for the U.S. Department of Energy, Aug. 2005, 1-64.
Judzis, A., Optimization of Mud Hammer Drilling Performance—A Program to Benchmark the Viability of Advanced Mud Hammer Drilling, Quarterly Progress Report, DOE Award No. DE-FC26-00NT40918, Aug. 2005, 1-13.
Kollé, J., et al., Hydropulses Increase Drilling Penetration Rates, Oil & Gas Journal, Mar. 29, 1999, 33-37.
Kollé, J., Increasing Drilling Rate in Deep Boreholes by Impulsive Depressurization, Tempress Technologies, Inc., 2000, 1-14.
Kollé, J., Hydraulic Pulse Drilling, Presentation for GTI Natural Gas Technologies II Conference, Feb. 8-11, 2004.
Kollé, J., HydroPulse™ Drilling, Final Report, U.S. Department of Energy Cooperative Development Agreement No. DE-FC-FT34367, Apr. 2004, 1-28.
Melamed, Y., et al., Hydraulic Hammer Drilling Technology: Developments and Capabilities, J. Energy Resources Technology, Mar. 2000, 122:1-7.
Staysko, R., et al., Fluid Hammer Drives Down Well Costs, SPE/IADC 139926, *SPE/IADC Drilling Conference and Exhibition*, Amsterdam, The Netherlands, Mar. 1-3, 2011, 1-6.
Tibbits, G., et al., Word's First Benchmarking of Drilling Mud Hammer Performance at Depth Conditions, IADC/SPE 74540, *IADC/SPE Drilling Conference*, Dallas, TX, Feb. 26-28, 2002, 1-8.
Tibbits, G., et al., Optimization of Mud Hammer Drilling Performance—A Program to Benchmark the Viability of Advanced Mud Hammer Drilling, Quarterly Progress Report, DOE Award No. DE-FC26-00NT40918m Terra Tech, Inc., Salt Lake City, UT, Jul. 2001, 1-15.
Wittig, V., et al., Innovative Hydraulic DTH Drilling Technology based on Coiled Tubing for Deep, Hard Rock Geothermal Drilling, Geophysical Research Abstracts, EGU2001-8709, EGU General Assembly, 2011, 1.

* cited by examiner

DRILLING APPARATUS AND METHOD

CROSS REFERENCE TO RELATED APPLICATION

The present application claims the benefit of, and incorporates by reference, U.S. Provisional Patent Application Ser. Nos. 61/509,389, filed Jul. 19, 2011, and 61/673,386, filed Jul. 19, 2012.

SUMMARY

Drilling for exploration and field preparation is a primary component of exploitation of natural resources, including oil, gas, water, minerals, and geothermal energy. Hammer drilling is often considered superior to other methods due to the best potential for the highest rate of penetration (ROP) and real-time seismic excitation for site properties and reservoir evaluation. However, the benefits can be mitigated at great drillhole depth, drilling mud pressure, density, and/or viscosity.

The present disclosure addresses the problem of decreasing penetration rate with downhole percussion drilling caused by the increasing mud pressure with depth and mud density. Hammer drilling is an efficient technique regarding cost and speed in shallow depth. However, pressure, density, and viscous effects typically degrade its advantages with increasing depth. In a particular embodiment, the present disclosure provides an integrated drill bit, hammer engine, and hammering cycle actuation design that combines rock hammer action with water/mud pressure/velocity waves (PVW), in which mud expansion energy is synchronously converted into percussion energy. An integrated drill bit, hammer engine, and hammering cycle actuation design is provided that combines rock hammer action with a controlled, balanced volume to reduce pressure variation in the drillhole and reduce compression energy. In another embodiment, the present disclosure provides a method and apparatus using multiple drill bits, the motion of which are synchronized for efficient PVW excitation in the drillhole.

According to one aspect of the disclosure, large-amplitude axial drill bit movement is allowed, which can increase the bit's impact energy for rock breaking by concentrating the overall, cycle-averaged energy to a shorter time period. Thus, this aspect of the disclosure can increase the "mechanical advantage" of the hammering action, that is, allowing for a long time period of hammer forward acceleration (at $a_F$), followed by a short time period for impact deceleration (at $a_I$), giving a high mechanical advantage of $a_I/a_F$. Axial drill bit motion is allowed at the face under extreme high drill string load, mud pressure, density, and viscosity. This free axial movement can be achieved by an arrangement of twin or triple drill bits and alternating, two- or three-phase bit motion control.

According to another aspect of the disclosure, the large-amplitude axial drill bit movement is used for enhanced rock chipping removal. This is due to a natural stirring and reciprocating mud pumping action by the axial movement of drill bits in the drillhole.

A further aspect of the present disclosure is active control of WOB in the drillhole, that is made possible by the twin or triple bit arrangement. In a particular implementation, one bit provides support for balancing the weight of the downhole string while the other bit(s) may move backward for hammering action or chipping removal.

Another aspect of the present disclosure provides dynamic control of the pressure at the bottom of the drillhole by periodic, positive displacement of a minute amount of mud volume by the axial pumping effects of the reciprocating drill bits. The net volume of the bits extended out of the hammer engine are engineered to create a positive (compression) or negative (depression) pressure/velocity wave at the bottom of the drill hole. The negative peak of the depression wave is synchronized with the time of the impact of the actively hammering bit. This way, energy from expansion of the fluid column is converted into mechanical energy and thus converted into percussion energy for rock breaking.

A further aspect of the disclosure provides for the reduction of energy loss due to reduced compression energy of the thrusting drill bit as it moves forward during impact into a high-pressure space, the bottom of the drillhole. This reduction is made possible by balancing the net, total volume of the moving parts in the drillhole to be nearly constant during hammer drilling. The compression cycle is slow and gentle in preparation for the expansion phase, a consequential pulsation around the averaged drillhole pressure.

In a particular implementation using aspects of the present disclosure, a plurality of reciprocating elements in the drillhole, including at least one hammer drill bit, are used with a synchronized, reciprocating motion and the creation of PVW that enhance, instead of hamper, rock breaking.

There are additional features and advantages of the subject matter described herein. They will become apparent as this specification proceeds.

In this regard, it is to be understood that this is a summary of varying aspects of the subject matter described herein. The various features described in this section and below for various embodiments may be used in combination or separately. Any particular embodiment need not provide all features noted above, nor solve all problems or address all issues in the prior art noted above.

Figure 4A:
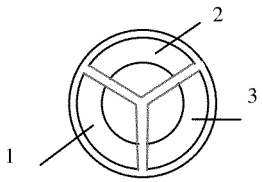
FIG. 4(A) is a plan view of a mud hammer having three, helical drill bits.
Figure 4B:
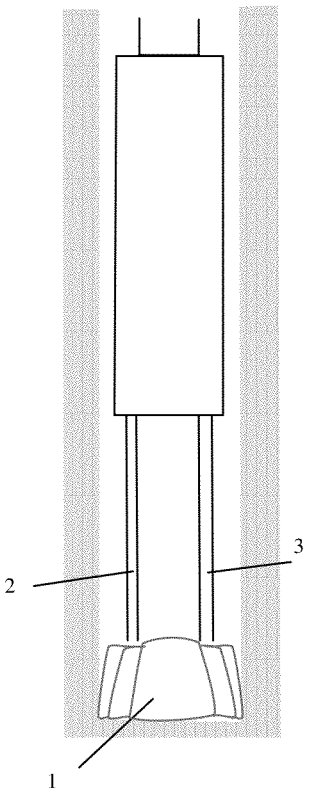
FIG. 4(B) is a schematic diagram of a mud hammer with a three-phase hammer bit being used in a borehole, illustrating hydrodynamic pressure control.

presents graphs of, from top to bottom, drill cavity pressure, bit 3 motion, bit 2 motion, and bit 1 motion versus time for the arrangement of FIG. 4(B).

DETAILED DESCRIPTION

Unless otherwise explained, all technical and scientific terms used herein have the same meaning as commonly understood by one of ordinary skill in the art to which this disclosure belongs. In case of conflict, the present specification, including explanations of terms, will control. The singular terms "a," "an," and "the" include plural referents unless context clearly indicates otherwise. Similarly, the word "or" is intended to include "and" unless the context clearly indicates otherwise. The term "comprising" means "including;" hence, "comprising A or B" means including A or B, as well as A and B together. All numerical ranges given herein include all values, including end points (unless specifically excluded) and any and all intermediate ranges between the endpoints.

In one embodiment, the present disclosure uses multiple, such as at least two, reciprocating elements in the drillhole including at least one, or multiple, hammer drill bits; move the elements with alternation to each other in such a way that the net volume displacement by the moving parts in the drillhole, ΔV, is controlled to be minimum for reducing compression work and thus for loosing useful energy from the available amount from the drill engine for rock breaking; but if desired, keep a small component of ΔV for creating PVW for enhancing rock chipping by tensile stress; and synchronize the peak of the pressure depression wave with that of the impact moment of the drill bit's reciprocating motion to enhance, instead of hamper, rock breaking by the creation of PVW.

Cyclic manipulation of downhole mud pressure around its mean in situ value is applied in high pressure systems. The disclosed method and apparatus can relieve downhole hammer drills from high mud pressure at critical instants, and work as if in a shallow well. Therefore, hammer drilling will made more practical for deep holes, allowing for its other advantages to be realized, such as increased bit life, improved trajectory alignment, low cost, and added benefits in seismic communications.

Existing mud hammer methods typically create downhole depression waves during percussion by periodically opening and closing a valve that controls the upward mud flow. According to the present disclosure, a mechanical, reciprocating drill head element is used to create downhole depression waves during percussion, as shown schematically in FIGS. 1(A) and 1(B).

Figure 1A:
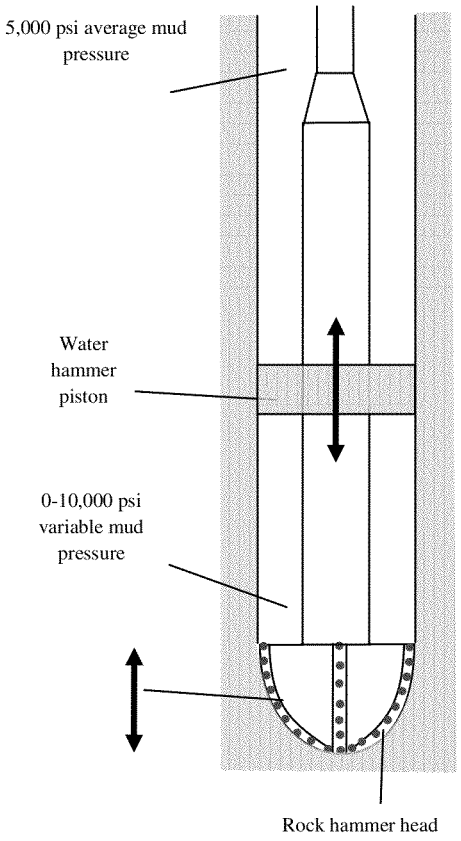
FIG. 1(A) is a schematic diagram of a mud hammer engine with a moving piston being used in a drilling cavity for dynamic pressure wave creation in a method according to the present disclosure.
Figure 1B:
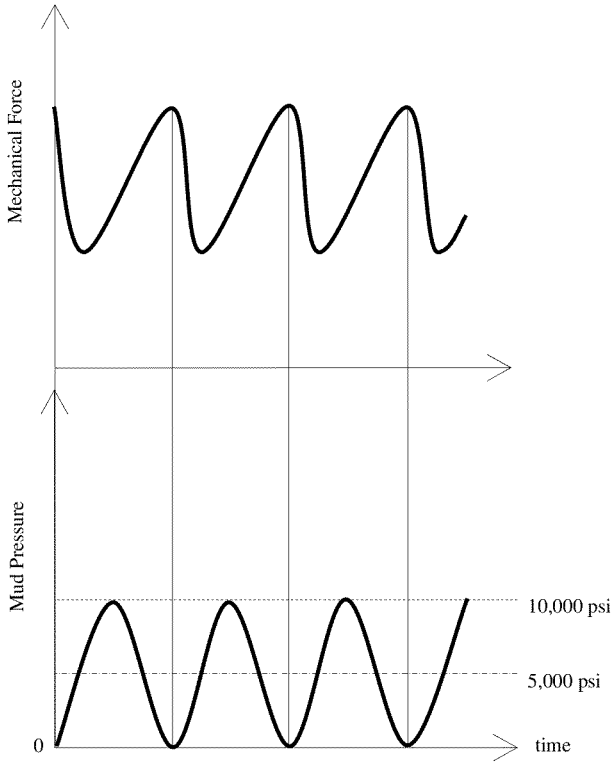
FIG. 1(B) presents graphs of mechanical force (upper graph) and mud pressure (lower graph) versus time, showing the desired variation of mud pressure and mechanical force on the bit with time in the arrangement of FIG. 1(A).

As shown in FIGS. 1(A) and 1(B), both the percussion drill bit and a hydraulic (mud) hammer piston reciprocate axially in opposite phase by the driving mechanism. The reciprocating piston movement in the drilling cavity is used to create pressure and velocity waves (PVW), also known as water hammers in the fluid dynamics literature, around the in situ hydrostatic pressure in the mud column. Compared to existing technologies to manipulate mud velocity control by closing and opening mud flow control valves, the disclosed embodiment is superior in its vigor, sharpness, and amplitude in PVW front creation. FIG. 1(B) illustrates time diagrams for the mechanical hammer force and the mud pressure as it is modulated between zero and example pressure of 10,000 psi around an example average of 5,000 psi downhole mud pressure.

Further improvements in PVW creation can be realized using a mud hammer that employs a reciprocating motion around a net zero compression volume in the high-pressure drilling zone. This improvement can reduce the loss of compression energy dissipation.

Figure 2A:
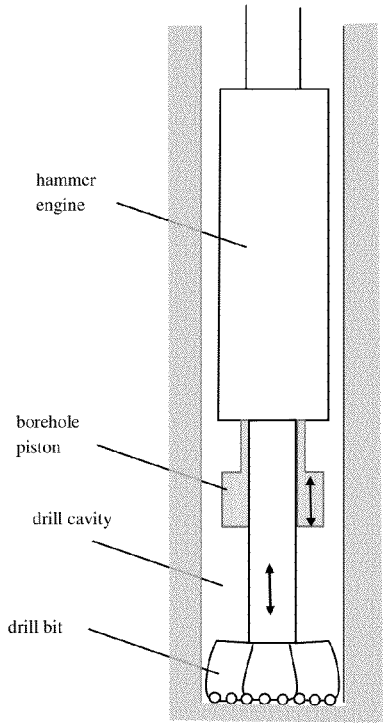
FIG. 2(A) is a schematic diagram of a mud hammer being used in a borehole, illustrating suction pressure creation with overall volume variation in the drill cavity using a borehole piston and a single drill bit.
Figure 2B:
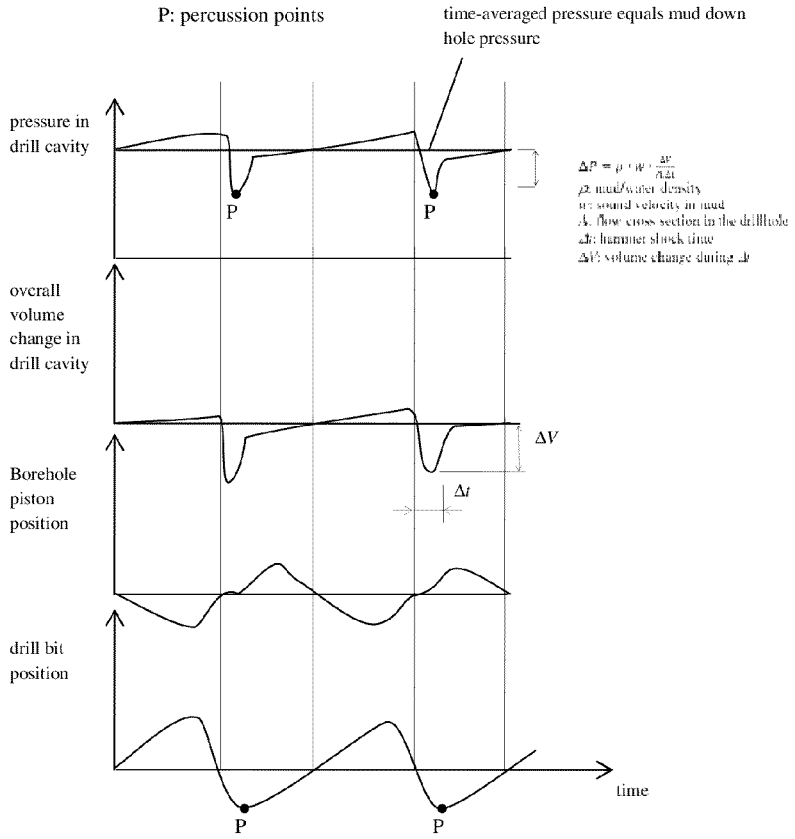
FIG. 2(B) presents graphs of, from top to bottom, drill cavity pressure, overall drill cavity volume change, borehole piston position, and drill bit position versus time for the arrangement of FIG. 2(A).

Another aspect of the present disclosure is described with reference to FIGS. 2(A) and 2(B). Periodic reciprocation of the drill bit may be used to create a periodic pressure and suction wave in the mud column. The net difference between the forward motion of the drill bit, connected to the driving hammer shaft, and the retreating piston expands the drillhole volume by a minute amount of ΔV as its volume is thrust into the drillhole during hammering. The expansion in volume, ΔV, during piston thrust causes mud acceleration and pressure increase, and vice versa. The basic formulation between expansion volume and compression/expansion pressure wave is:

$$\Delta P = \rho \cdot w \cdot \frac{\Delta V}{A \cdot \Delta t}$$

ρ: mud/water density
w: sound velocity in mud
A: flow cross section in the drillhole
Δt: hammer shock time
ΔV: volume change during Δt To provide the correct timing of the suction pressure with the moment of rock breaking, the motion pattern of the piston and the single drill bit are preferably synchronized and the outstretching and retreating volumes appropriately engineered. A solution example is presented with net volume (and corresponding pressure) reduction at the critical percussion time instant in FIG. 2(B). As shown, only a small, negative ΔV spike at the right moment is created to induce a depression wave.

Volume change caused by drill rod and bit reciprocation in hammer drilling is a natural and vigorous process, causing pressure pulsations in the drillhole. It happens spontaneously in typical current hammer drilling, as conventional drills usually operate only one bit and a large ΔV can result. Volume change is evidenced by strong pressure pulsations shown in measurements. There are two issues with these spontaneous pressure pulsations: (a) their timing can be counter-productive, as pressure increases during bit forward thrust, thus hampering rock breaking by increasing the confining stress in the rock; and (b) the large volume change against high drillhole pressure causes compression work exerted on the water/mud column in the drillhole.

A fundamental reason for ROP decline with increased mud pressure is the loss of useful hammer engine power for rock breaking due to compression energy dissipation and loss of useful rock breaking power. Conventional hammer heads and bits thrust a ΔV shaft volume into the drillhole, displacing a mud volume of ΔV during each percussion cycle. This ΔV volume compression against the drillhole pressure consumes, in the form of compression work, useful energy that is delivered by pressurized mud flow available for rock breaking. This loss can be reduced, or eliminated, and turned to be negative (i.e., a gain) by expanding the drillhole volume at the right moment of rock breaking with synchronized retreat of a drill member during depression PVW creation.

If a drill bit is thrust into a high-pressure space with ΔP pressure difference and displaces a mud volume of ΔV, then the energy dissipation is ΔW=ΔV*Δp, and the power is ΔP=ΔV/Δt*Δp, where Δt is the duration of the thrust. If the movement is periodic without hydraulic power recovery, the energy dissipation is a loss from available rock breaking energy.

Assuming a percussion hammer amplitude of ½" and shaft diameter of 3", the volume is 3.53 $in^3$. Assuming $\Delta p$=800 psi difference between pumping and mud pressures in the well at the drill and mud flow rate of 4,000 gpm, the compression power is 83.78 hp. This is 45% of the total gross drill engine power of 183.2 hp from a typical operation with 4,000 gpm mud flow at 800 psi pressure drop at the hammer engine. This example shows that the hammer reciprocation, if unbalanced in terms of net volumetric change during cycling, may cause a very significant, unrecoverable loss in hydraulic power.

Rock breaking power savings for rock penetration can be achieved if a balanced volume of the hammer head is designed. A new hammer engine and bits can be designed, as an example, so that the total (hammer housing plus bit) volume during hammering cycles is nearly constant, i.e., balanced. Such a balanced solution is advantageous, with an added modulation for pressure lowering, shown in FIGS. 3(C) and 4(C), at the critical percussion (rock breaking) point. Since the pressure is lowered, that is, the compression energy is negative, this PVW creation takes away energy from the mud and converts it into percussion energy. This is the opposite of what happens in currently-used mud hammers, the primary cause of ROP decline (through breaking energy decline) with drillhole pressure. This recognition explains the ROP decline in a proportional way to drillhole mud pressure. The mitigation of this power loss element is an aspect of the present disclosure.

Implementation of the new volume control, mud fluid pressure modulation, rock chipping removal, and WOB control technique are explained with the help of FIGS. 1 through 4. The water/mud PVW is be created with the drilling tool as a positive volume replacement plunger piston in the cylinder volume of the drilling hole at the bottom. The movement patterns of the drilling tool or drill bits in the twin or triple arrangements, shown in FIGS. 3(B), 3(C), 4(B), and 4(C), are designed and tuned for synchronizing the water/mud pressure wave with the mechanical hammer action for (a) reducing the loss of drilling power due to near-balanced net volume change, $\Delta V$, thus, a minimized compression energy dissipation in the drillhole; (b) reducing pressure periodically and shortly during the rock breaking phase; while (c) enhancing the removal of rock chippings; as well as (d) facilitating the control of WOB.

Figure 3A:
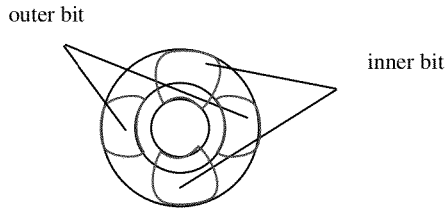
FIG. 3(A) is a plan view of a mud hammer having twin, inner and outer, drill bits.
Figure 3B:
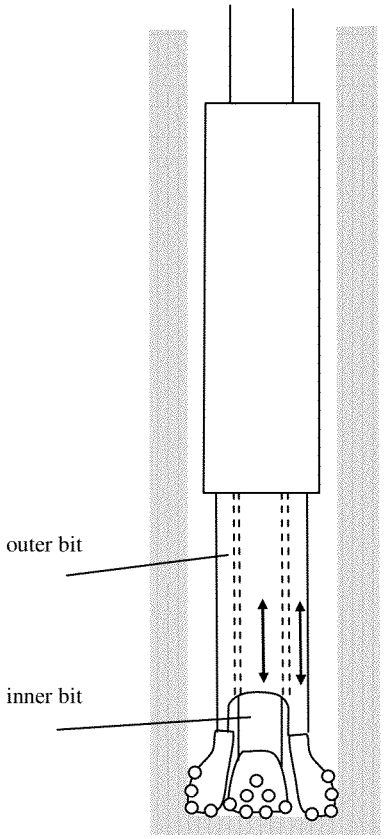
FIG. 3(B) is a schematic diagram of a mud hammer being used in a borehole, illustrating suction pressure creation with overall volume variation in the drill cavity using a borehole piston and twin drill bits.
Figure 3C:
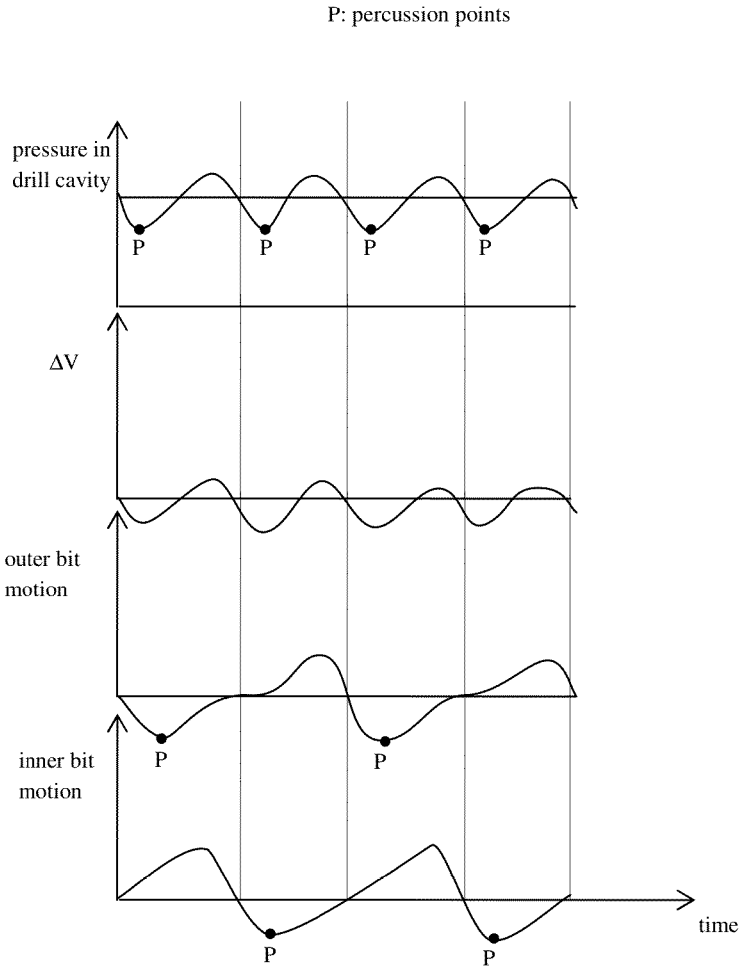
FIG. 3(C) presents graphs of, from top to bottom, drill cavity pressure, overall drill cavity volume change, outer bit motion, and inner but motion versus time for the arrangement of FIG. 3(B).

An integrated solution example with a twin drill bit arrangement is shown for the implementation of controlled, engineered net volume change, $\Delta V$, in FIGS. 3(A)-3(C). Two bits in alternating, cyclic motion are shown how to reach the stated goals. The twin bits can be used to (a) reduce the loss of drilling power due to near-balanced net volume change, $\Delta V$, thus, to reach a minimized compression energy dissipation in the drillhole; and (b) lower mud pressure in the drilling cavity and to overcome the culprit in ROP decline with average drillhole pressure. The alternating movements of the two bits can be combined with fluid jets, such as fluid jets from Novatek Inc., of Provo Utah, for bit steering. The large-amplitude, reciprocating motion of the two bits can enhance rock drilling chips removal. In addition, the alternating movement is beneficial in downweighting the returning bit, resulting in active weight-of-bit (WOB) control, and providing space for acceleration for the creation of an efficient impact in the striking phase, hence, creating a sufficiently large "mechanical advantage."

Figure 4C:
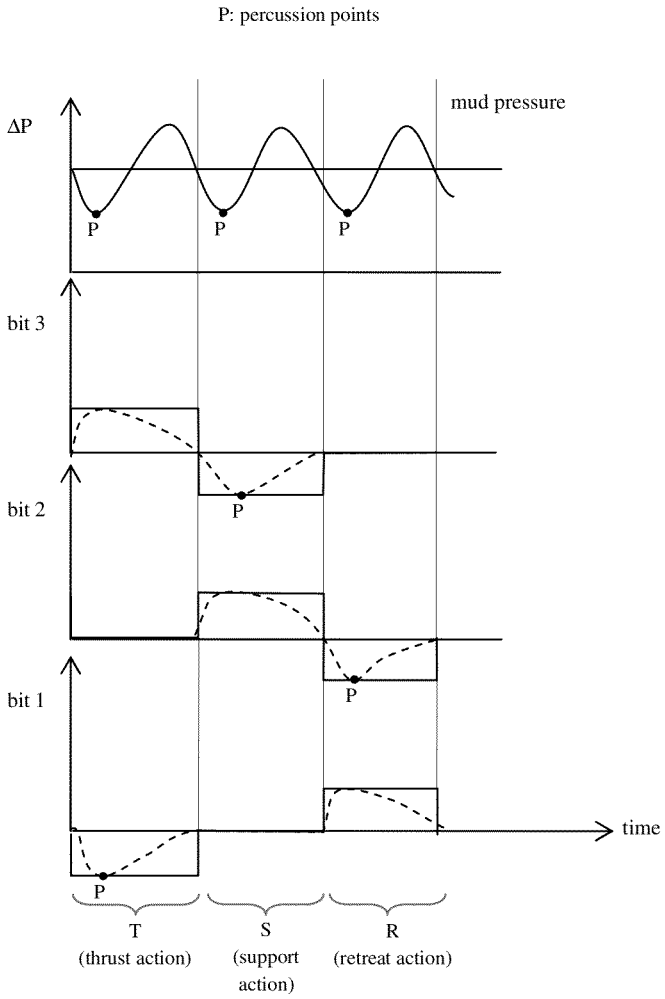
FIG. 4(C)

Another integrated solution example with a triple drill bit arrangement is shown for the implementation of controlled, engineered net volume change, $\Delta V$, in FIGS. 4(A)-4(C). Three bits in alternating, cyclic motion are shown. The triple bits can be used to (a) reduce the loss of drilling power due to near-balanced net volume change, $\Delta V$, thus, to reach a minimized compression energy dissipation in the drillhole; and (b) lower mud pressure in the drilling cavity and to overcome the culprit in ROP decline with average drillhole pressure. The alternating movements of the two bits can be combined with fluid jets, such as from Novatek Inc., of Provo, Utah, for bit steering. The large-amplitude, reciprocating motion of the two bits can enhance rock drilling chips removal. In addition, the fact that one bit can always provide axial support is beneficial in downweighting the returning bit, resulting in active weight-of-bit (WOB) control. The design of the hammer engine and bits can be integrated with downhole mud hammers, such as steerable downhole mud hammers available from Novatek Inc., of Provo, Utah.

Steerability of the arrangement may also be provided by hammering cycle time adjustment for the individual bits in the triple bits arrangement, shown in FIGS. 4(A)-4(C). For example, if the bit at R-phase position impacts at higher power (and efficiently removes the rock chippings), the drillhole may gradually bend. Timing and synchronizing may be provided by a steerable mud hammer with a rotating hydraulic valve set, such as those available from Novatek Inc., of Provo, Utah. This valve set can control the hammering cycles of the individual drill bits while hammering and rotating at the same time in such a way that the bits hammer a particular segment of the full circle of the drilling cross section (e.g., between 1 μm and 5 μm if a clock dial analogue is figuratively used, in order to achieve a turn in 3 μm direction). A similar solution may be designed for the twin-bit arrangement.

Twin or triple, or multiple cutter bits may be arranged in one drill hole for achieving the intended actions described in the foregoing. The individual drill bit cutters may be reciprocated axially and rotated together simultaneously within the borehole. Rotation may include planetary motion, that is, rotation within the borehole around the axis of the drillhole together and individual rotation of each bit cutter around its axis. Rotation within the borehole or rotation of the individual cutter bits may be segmental, known as indexing in the hammer drills literature. Indexing may be actuated by the axial reciprocation of the cutter bits.

An exemplary variation of directional steering is the synchronous, stroboscopic variation of the rotation of the individual cutting bits, assigning more vigorous rotation to a given segment of the drillhole and thus increasing the relative advance rate to this segment. Such a rate change in one segment is known to generate a directional bend in the drilling direction.

The invention can be realized by means of various actuator arrangements. A particularly advantageous solution is seen for the process of percussion drilling with multiple cutter bits that comprises a modular arrangement in which each module is connected to an individual cutter bit as a motion actuator.

The embodiments are illustrative, and not intended to limit the scope of the present disclosure. The scope of the present disclosure is rather to be determined by the scope of the claims as issued and equivalents thereto.

I claim:

1. A drilling method comprising, in a downhole environment, establishing a regular, repeating, synchronized hammering cycle, each cycle comprising:

actuating a first reciprocating rock-breaking element to impact a rock formation;

as the first reciprocating rock-breaking elements impacts the rock formation, actuating a pressure-cycling member comprising second and third reciprocating rock-breaking elements to decompress fluid proximate the first rock-breaking element;

actuating the first reciprocating rock-breaking element away from the rock formation;

as the first reciprocating rock-breaking element is moved away from the rock formation, actuating the pressure-cycling member to compress fluid proximate the first rock-breaking element; and during the cycle, varying the impact strength of one or more of the first, second, and third reciprocating rock-breaking elements to steer a drill bit comprising the first, second, and third reciprocating rock breaking elements;

wherein decompression of the fluid proximate the rock formation as the first reciprocating rock-breaking element impacts the rock formation creates pressure and velocity waves to enhance rock breaking.

2. The drilling method of claim 1, wherein the pressure-cycling member comprises a plunger piston.

* * * * *